US006920648B1

(12) United States Patent
Suski et al.

(10) Patent No.: US 6,920,648 B1
(45) Date of Patent: Jul. 26, 2005

(54) URINE DISPERSING URINAL INSERT DEVICE

(76) Inventors: Michael R. Suski, 9827 Naranja Ave., Mesa, AZ (US) 85212; Michael F. Suski, 9827 Naranja Ave., Mesa, AZ (US) 85212

( * ) Notice: Subject to any disclaimer, the term of this patent is extended or adjusted under 35 U.S.C. 154(b) by 15 days.

(21) Appl. No.: 10/692,810

(22) Filed: Oct. 27, 2003

(51) Int. Cl.[7] ..... A47C 19/00
(52) U.S. Cl. ..... 4/309; 4/222.1; 4/300.3; 4/301; 4/DIG. 5
(58) Field of Search ..... 4/301, 300.3, 309, 4/222, 222.1, DIG. 5

(56) References Cited

U.S. PATENT DOCUMENTS

| | | | | |
|---|---|---|---|---|
| 353,445 | A | 11/1886 | Morad | |
| 487,130 | A | 11/1892 | Schoen | |
| 1,880,962 | A | 10/1932 | Koppelman | |
| 3,597,772 | A | 8/1971 | Leavitt et al. | 4/222 |
| 3,760,429 | A | 9/1973 | Brownstein | 4/109 |
| 3,824,633 | A | 7/1974 | Van Vlahakis | 4/109 |
| 4,103,367 | A | 8/1978 | Kaufer | 4/222 |
| 4,135,261 | A | 1/1979 | Uhrman | 4/222 |
| 4,143,431 | A | 3/1979 | Goncalves | 4/231 |
| 4,574,400 | A | 3/1986 | Annowsky | 4/222.1 |
| 4,574,403 | A | 3/1986 | Dintemann et al. | 4/309 |
| 4,615,054 | A | 10/1986 | Buecheler et al. | 4/231 |
| 5,165,119 | A | 11/1992 | Yamato | 4/309 |
| 5,336,424 | A | 8/1994 | Van Vlahakis et al. | 252/89.1 |
| 5,365,616 | A | 11/1994 | Morad | 4/309 |
| 5,465,901 | A | 11/1995 | Paine, Jr. | 229/407 |
| 5,774,905 | A * | 7/1998 | Wager et al. | 4/309 |
| 6,269,490 | B1 | 8/2001 | Suski et al. | 4/309 |

* cited by examiner

*Primary Examiner*—Gregory L. Huson
*Assistant Examiner*—Kathleen J. Prunner
(74) *Attorney, Agent, or Firm*—Jacobson Holman PLLC

(57) ABSTRACT

A disposable, deodorant and splash proof urine dispersing device for placement in a urinal including a framework made of scented plastic material with a horizontal segmented supporting base and a central raised housing. The supporting base includes a plurality of perforated flexible segments and a central bottom frame with a central opening aligned with an outlet or drain in the urinal. The opening is surrounded by the multiple segments such that the device can flex and adapt to urinals of different sizes and designs. The central raised housing includes a horizontal or inclined top member and an upstanding peripheral wall connecting the top member with the central bottom frame in the supporting base. The peripheral wall includes flush relief openings and tapered for easy unit stacking. The top member includes a frame with a plurality of spaced parallel rods having a unique configuration for dispersing urine flow with reduced back splashing toward the user of the urinal.

20 Claims, 3 Drawing Sheets

URINE DISPERSING URINAL INSERT DEVICE

BACKGROUND OF THE INVENTION

1. Field of the Invention

The present invention relates generally to a urine dispersing urinal insert and, more particularly, to a disposable, deodorant and splash proof urine dispersing device which is made of a scent impregnated plastic material or materials for deodorization purposes with a central raised housing and a segmented flexible supporting base for adapting to urinals of various sizes and designs.

2. Description of the Prior Art

Deodorant block holders are commercially available and generally include a flexible pad with a perforate receptacle on the upper surface of the pad for receiving a deodorant block which must be periodically replaced. The replacement of the deodorant block is somewhat difficult. The construction of some presently available commercial devices utilize upwardly facing flat surfaces which cause splashing of urine when urine flow impacts against the flat surfaces. Some splash-proof inserts have been developed to address the splashing problem including our prior U.S. Pat. No. 6,269,490 issued August 7, 2001. This patent and other prior art of record therein are incorporated herein by reference thereto.

The prior art discloses structures associated with urinals in the flow path of urine and include screen structures, slotted receptacles and dispersing filters with spaced parallel rods having sharp bottom edges to enable discharge of urine to the outlet of the urinal and reduce splashing. The prior art, however, does not disclose the specific structural arrangement of the embodiments of the present invention. Specifically, the prior art does not disclose a urine dispersing device that includes a flexible segmented supporting base having a central opening defined by a peripheral frame aligned with the urinal drain and a central raised housing having a top member with spaced rods and that is made of a scented plastic material or materials thereby eliminating use of deodorant blocks. Further, the prior art does not disclose the specific construction of the segmented supporting base with undercut and tapered rods to enable the insert to supportingly engage urinals of various sizes and designs. Finally, the prior art does not disclose urine dispersing devices with angled peripheral walls for easy stacking, packaging and sale.

SUMMARY OF THE INVENTION

The disposable, deodorant and splash proof urinal dispersing device of the present invention comprises a framework made of scented plastic material or materials containing at least one type of scent additive. The framework includes a horizontal segmented supporting base with an opening aligned with an outlet opening or a drain in a urinal and a central raised housing. The supporting base has a plurality of perforated segments and a central frame defining the central opening which is surrounded by the segments. The central raised housing has a perforated top member and an upstanding peripheral wall connecting the top member with the central frame in the supporting base. The peripheral wall of the housing includes at least one flush relief opening and is preferably tapered for easy unit stacking. The top member includes a top frame having a plurality of spaced parallel rods which define continuous openings extending from front to rear of the housing and generally in the path of movement of urine being discharged into the urinal. This structure provides a maximum open urine target area for dispersing urine flow without splashing back towards a user of the urinal.

The supporting base is segmented, which is not disclosed or used in conventional urinal block holders or dispersing devices. The segmented supporting base provides more flexibility and resilience for the urinal dispersing device to adapt to urinals of different sizes and designs. In particular, the supporting base can adjust to urinals with different shapes of bottom designs. In addition, the segmented supporting base is perforated and preferably includes a plurality of openings formed by rod members extending radially outwardly from the central frame. These rod members are progressively tapered toward the distal ends thereof. The tapered supporting rod members provide additional flexibility to the base for adapting to urinals of different sizes and designs. Moreover, the rod members preferably have a notch or notches in their bottom surfaces near the proximal ends to provide further flexibility to the supporting base. For example, the rod members are able to bend upward further than rod members without the notches on tapered configuration to enable the supporting base to fit and conform with, and supportingly engage, urinals of different sizes and designs, for example, a urinal with a deep curved bottom configuration.

The central raised housing includes a perforated top member, which can be horizontal or inclined. The top member preferably has an arch shape. The peripheral wall connecting the top member with the supporting base can be vertical or inwardly inclined from the supporting base to the top member. An inwardly inclined peripheral wall is preferred because such shape permits the urinal dispersing device of the present invention to stack one on another in a nested overlap relation, thus taking less space, using less resources and easier for packaging, storage and transportation. In addition, urinal dispersing devices are usually sold in six units as one package. Such shape is also convenient for taking orders and sales in a business operation. The peripheral wall also includes openings for the release of urine entered from the top of central raised housing. The top member preferably has rods serving as dispersing filters. The rods preferably include a partial cylindrical or convexly curved upper surface and a V-shape lower surface defining a narrow edge to facilitate dispersing of the urine flow and reduce capillary action along the surface of the rods.

The dispersing device of the present invention is preferably made of a scented plastic material or other suitable material containing at least one type of scent additive. Because the scented material can function as a deodorant agent, deodorant blocks are not needed, and the device can serve both as a urinal dispersing device and as a urinal deodorant device. The scent additives can be chosen from many different conventional scents usually used in bathroom for deodorant purposes including, for example, flower scents, fruit scents, mint scents, citrus scents, gum scents, cherry scents and the like. The deodorant scent additive molded into or added to the plastic or other material preferably has a deodorant life of 30 to 60 days, which is generally longer than the life of conventional deodorant blocks used in urinal block holders. When the deodorant scent additive has dissipated from the dispersing device during use, the device is simply thrown away. Because the urinal dispersing device is disposable, a longer deodorant life saves resources.

It is therefore an object of the present invention to provide a disposable, deodorant and splash proof urine dispersing urinal insert device which comprises a framework made of a scented plastic material or materials containing at least one type of scent additive, and the framework includes a segmented supporting base and a central raised housing. The segmented supporting base includes a plurality of perforated segments and a central bottom frame defining a central opening surrounded by the segments. The central raised housing has a top member and an upstanding peripheral wall connecting the top member with the central bottom frame in the base, and the peripheral wall includes at least one opening. The top member is a top frame with a plurality of spaced parallel rods for dispersing urine flow without splashing back toward a user of the urinal.

It is a further object of the present invention to provide a urine dispersing device in accordance with the preceding object in which the upstanding peripheral wall is tapered inwardly so that multiple urinal inserts in accordance with the present invention can be stacked in a nesting relation for improved packaging, storage and transport.

Another object of the present invention is to provide a urine dispersing device including supporting base segments with a plurality of slot openings formed by a plurality of rods extending outwardly from the central bottom frame in a radial direction.

A further object of the present invention is to provide a urine dispersing device in accordance with the preceding object in which the radially extending rods in the segmented supporting base each include at least one notch in the bottom thereof adjacent the central bottom frame to increase the flexibility of the base segments.

Still another object of the present invention is to provide a urine dispersing device in which the plurality of rods extending outwardly in the segmented supporting base are progressively tapered to their distal ends to increase the flexibility of the base segments.

Yet another object of the present invention is to provide a urine dispersing device in which the top member on the raised housing includes an arch shaped rear end distal from a front wall of the urinal with the top member being either horizontal or inclined upwardly toward the rear of the urinal.

A still further object of the present invention is to provide a urine dispersing device wherein the upstanding peripheral wall is inwardly inclined from the base to facilitate stacking.

An additional object of the present invention is to provide a urine dispersing device wherein each of the rods in the top member includes a partial cylindrical or curved upper surface and a V-shaped lower surface defining a narrow edge to facilitate dispersion of the urine flow and reduce capillary action along the surfaces of the rods.

Another additional object of the present invention is to provide a urine dispersing device in which the scented plastic or other material making the device has a deodorant life about 30 to 60 days, and the scent additive is selected from the group consisting of flower scents, fruit scents, mint scents, citrus scents, gum scents, cherry scents, and the like.

A final object to be set forth herein for the present invention is to provide a urine dispersing device in accordance with the preceding objects which can be readily manufactured using known and simple manufacturing techniques and materials and will be easy to use, package, store and transport.

These together with other objects and advantages which will become subsequently apparent reside in the details of construction and operation of the invention as more fully hereinafter described and claimed, reference being had to the accompanying drawings forming a part hereof, wherein like numerals refer to like parts throughout.

DESCRIPTION OF THE PREFERRED EMBODIMENT

Figure 1:
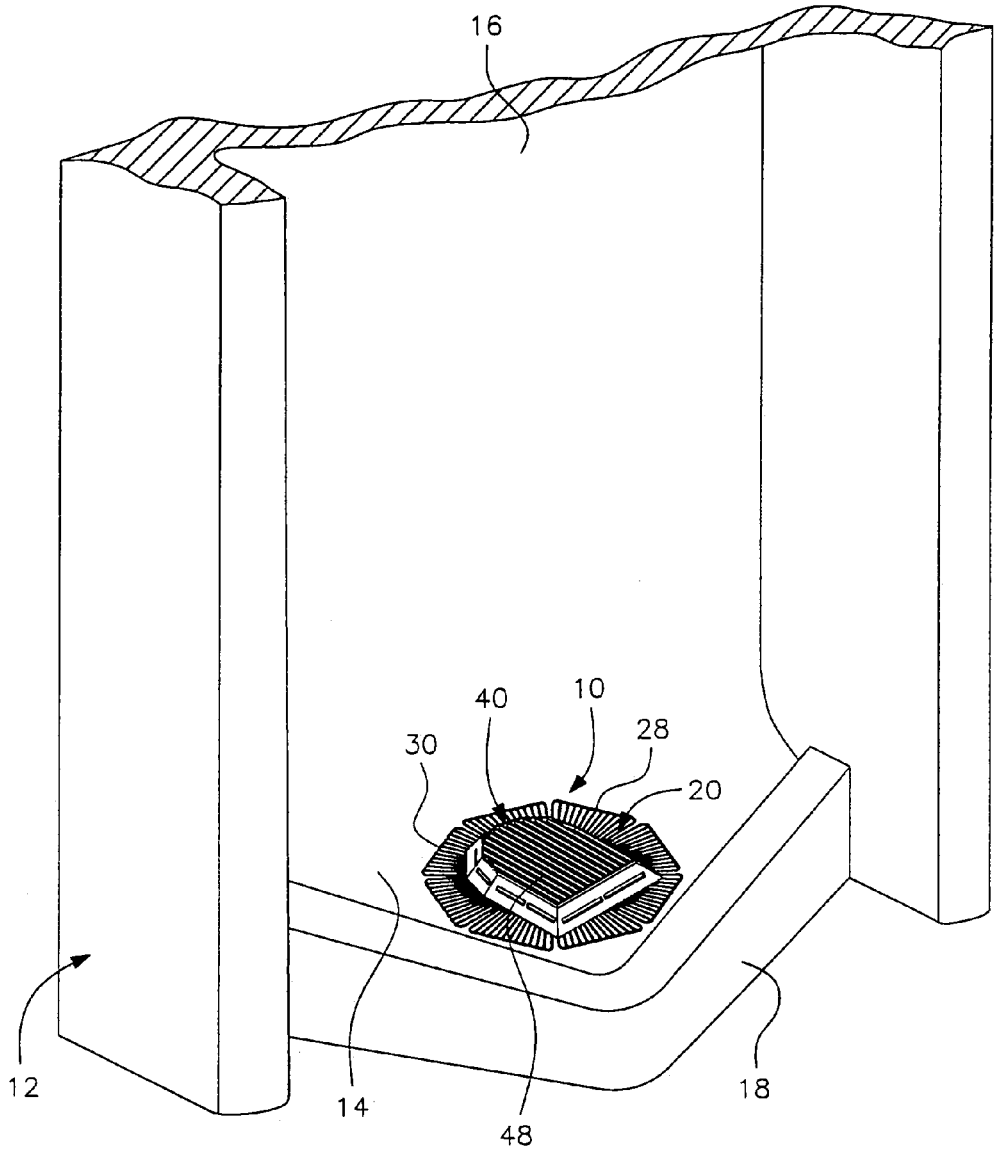
FIG. 1 is a perspective view of the urine dispersing device of the present invention positioned in a urinal in overlying relation to a urinal drain or opening (not shown).

Although only one preferred embodiment of the invention is explained in detail, it is to be understood that the invention is not limited in its scope to the details of construction and arrangement of components set forth in the following description or illustrated in the drawings. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose.

FIG. 1 of the drawings illustrates one embodiment of the urine dispersing device of the present invention, generally designated by reference numeral 10. The dispersing device 10 is installed in a conventional urinal, generally designated by reference numeral 12, provided with an outlet or drain (not shown) in the curved bottom wall 14 which extends between the back panel 16 and a lower front wall 18 extending upwardly above the bottom wall 14. The urinal 12 is of conventional construction and the dispersing device 10 is positioned in overlying relation to the outlet and rests upon the surface of the bottom wall 14.

As illustrated in FIGS. 2–7, the dispersing device 10 preferably includes a horizontal generally octagon shape segmented supporting base, generally designated by reference numeral 20, and a central raised housing, generally designated by reference numeral 40. The supporting base 20 preferably includes a central bottom frame 22 of generally arch shape surrounded by eight base segments generally designated by reference numerals 24*a*, 24*b*, 24*c*, 24*d*, 24*e*, 24*f*, 24*g* and 24*h*, respectively. The central bottom frame 22 preferably includes a central opening 26, which is generally positioned around or above an outlet (not shown) in the bottom wall 14 of urinal 12. Each of the base segments 24*a*–*h* preferably includes a plurality of spaced parallel rods 28 extending outwardly from the central bottom frame 22 in a radial direction which form a web-like shape. The distal ends of these rods 28 join a peripheral member 30 of each base segment. A plurality of slot openings 29 are formed between the rods 28.

Figure 7:
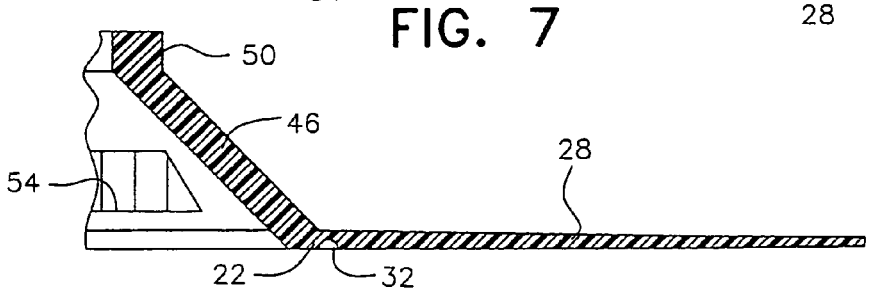
FIG. 7 is a vertical sectional view of a side of the central raised housing and the rods forming the base segments of the urine dispersing device of the present invention, on an enlarged scale, taken along section line 7—7 on FIG. 2, and illustrating the notch in the bottom surface of the rods and the taper of the rods toward their distal ends.

The segmented structure of the supporting base 20 provides flexibility and resilience to the dispersing device 10 when engaging the bottom wall 14 of a conventional urinal 12, which can be in different sizes and configurations. Further, each rod 28 is preferably progressively tapered in its vertical height from the central bottom frame 22 toward the peripheral member 30 which connects the distal ends of rods 28, as illustrated in FIG. 7. The tapering of rods 28 also provides more flexibility to the segments 24*a–h* when engaging the bottom wall 14 of the conventional urinal 12.

In addition, each of the rods 28 preferably includes at least one notch 32 in its bottom surface near the central bottom frame 22, as illustrated in FIG. 7 to increase the flexibility of each rod 28 and each of the segments 24. It is also possible that not all rods 28 have a notch 32. The notches 32 can be semi-circular or U-shape or other shapes to provide further flexibility to the supporting base 20. For example, the rods 28 can flex upwardly to engage a urinal 12 with a curved bottom surface wall 14 or urinals of other type configuration.

Figure 3:
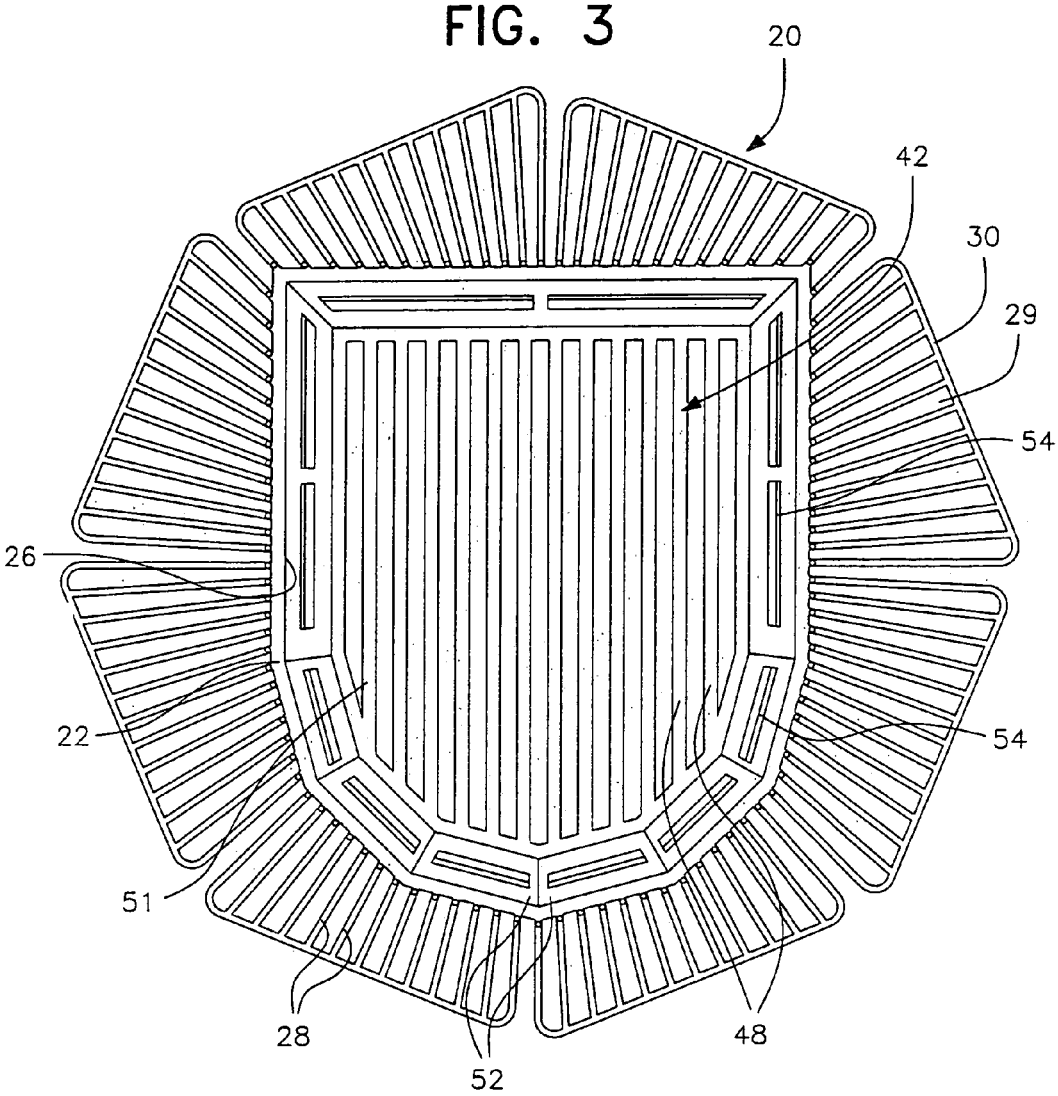
FIG. 3 is a bottom plan view of the urine dispersing device of the present invention when rotated about a transverse axis.
Figure 6:
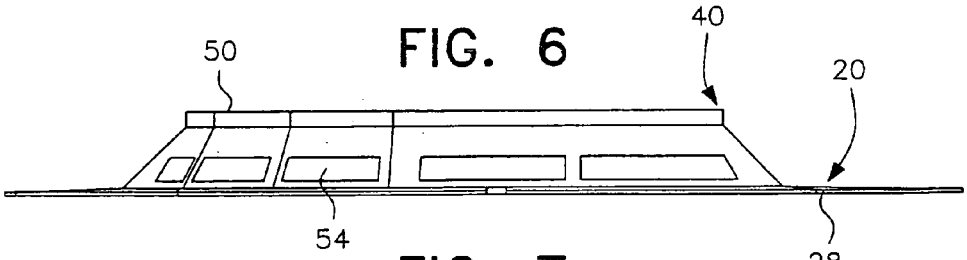
FIG. 6 is a left side elevational view of the urine dispersing device of the present invention.

As illustrated in FIGS. 2–7, the central raised housing 40 of the dispersing device 10 preferably includes a top member, generally designated by reference numeral 42, and an upstanding peripheral wall, generally designated by reference numeral 46. The top member 42 preferably includes a top frame 44 and a plurality of spaced parallel dispersing rods 48 for dispersing urine flow without splashing back toward a user of the urinal 12. The peripheral wall 46 connects the top frame 44 with the central bottom frame 22, as illustrated in FIG. 3. Therefore, the present invention centralizes the flow of urine and directs it toward the region of the urinal outlet without any splash back onto the user of the urinal or any other part of the urinal.

Figure 8:
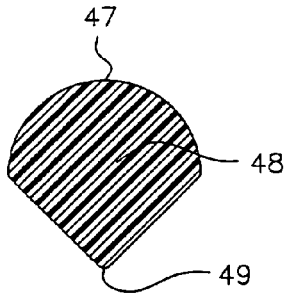
FIG. 8 is a vertical sectional view, on an enlarged scale, illustrating the cross sectional configuration of one of the top member rods.
Figure 2:
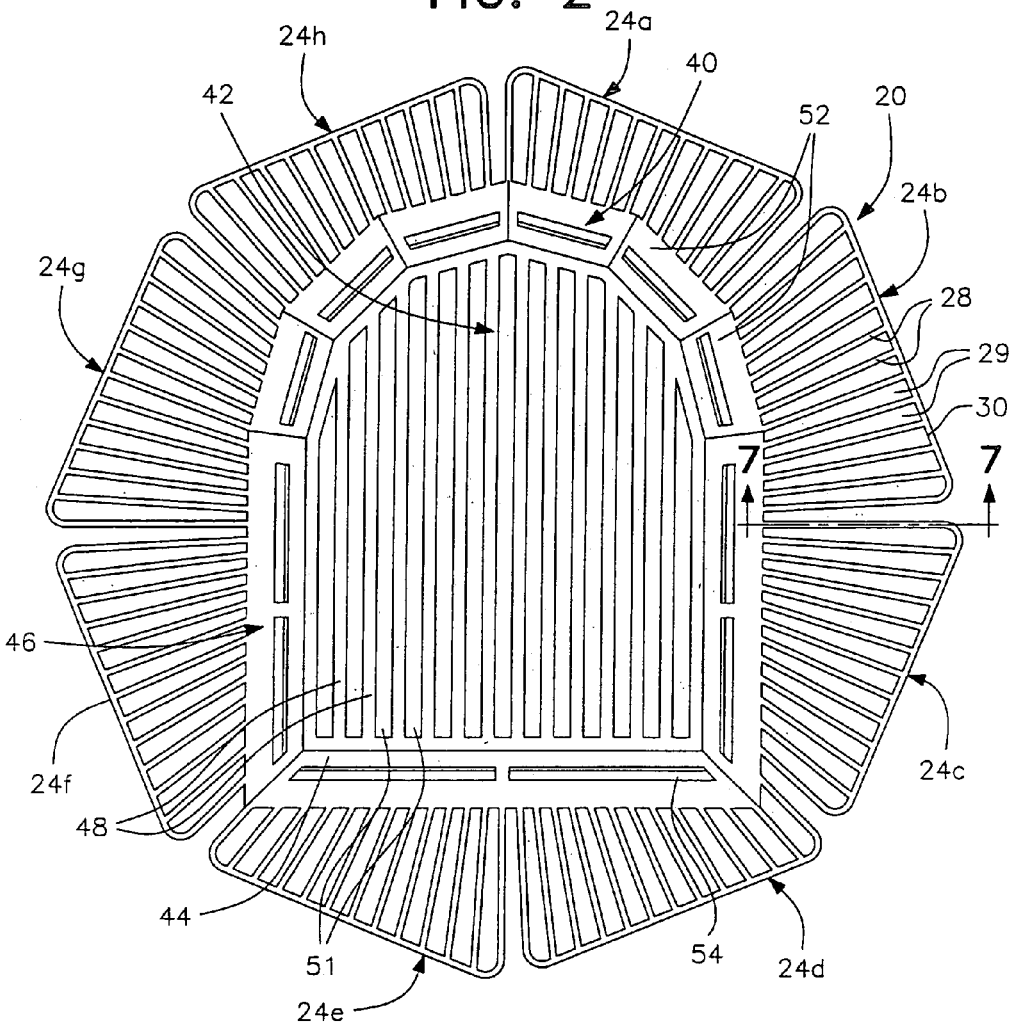
FIG. 2 is a top plan view of the urine dispersing device of the present invention illustrating the relationship between the base segments, the upstanding peripheral wall and top member of the central housing.
Figure 4:
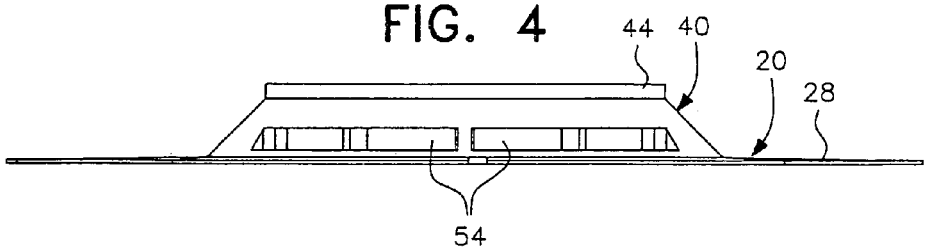
FIG. 4 is a front elevational view of the urine dispersing device of the present invention.
Figure 5:
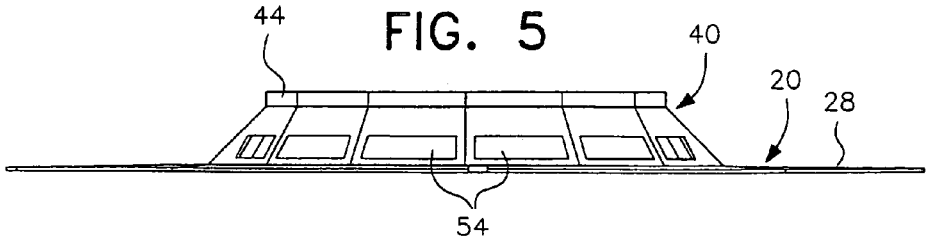
FIG. 5 is a rear elevational view of the urine dispersing device of the present invention.

The top frame 44 is preferably in generally arch shape with the front side (the side near the lower front wall 18 of a urinal 12, or near the user of a urinal 12 when the dispersing device is in use) being of square shape and the back side being semi-circular or arch shape. The top member 42 can be either horizontal or inclined upwardly toward the back panel 16. The top member 42 preferably includes a plurality of spaced parallel dispersing rods 48 extending longitudinally, front to back, between opposite front and back sides of the top member 42. Each of the dispersing rods 48 has a generally semi-cylindrical upper surface 47 and a V-shaped lower edge 49 defining a narrow knife like edge as illustrated in FIG. 8. The space 51 between dispersing rods 48 preferably is generally equal to the width of the rods 48 with a total open space generally equal to the total rod area to facilitate passage of urine through top member 42. In addition, the spacing and configuration of the dispersing rods 48 in the top members 42 are important in order to direct urine impinging on the curved upper surface 47 of rods 48 laterally into spaces 51 between the rods 48 rather than splashing toward front wall 18 and the urinal user. Preferably, the width of the dispersing rods 48 and the open space 51 between the adjacent dispersing rods in the top member are both about ⅛ inch.

The peripheral wall 46 of the central raised housing 40 in the preferred embodiment is inclined downwardly and outwardly with an upper portion of each wall being vertically oriented as indicated by reference numeral 50, as illustrated in FIG. 7. Because of the arch shape of the central raised housing 40, the back side of the central raised housing 40 is in generally half-circular shape. In the preferred embodiment, there are six adjacent planar side surfaces 52 with each surface joining its neighbor surfaces in a wide angle, together forming the generally half-circular shape of, the back side of the peripheral wall 46. The peripheral wall 46 preferably includes a plurality of slot openings 54, which enable passage of urine entering from the top and side of central raised housing 40. The slots 54 also provides for passage of flush water cascading down the wall surface 16 of the urinal 12 and passing over the base segments. The peripheral wall 46 can also be in a vertical position. The advantage of the angled peripheral wall 46 is that such shape permits one urine dispersing device 10 to stack in a partial nesting relation on another same device 10 with overlaps, thus taking less space, using less resources and easier for packaging, storage and transport. In addition, urine dispersing devices are usually sold in six units as one package. Such shape is also convenient for taking orders and sales in a business operation.

The urine dispersing device of the present invention is preferably made of any conventional plastic material known with added scent additives for molding or forming semi-rigid plastic products of this type. The methods of making such scented plastic materials are well known in the relevant art. The scent additive or the fragrance mixture is usually a concentrate containing a non-toxic scented chemical added into a base plastic, usually polypropylene or polyethylene in a pelletized form. As with every scented product, they can be tested to achieve a desired life expectancy. Due to the characteristics of the dispersing device of the present invention, the concentrate would be preferably at the low end of the percentage scale, around 5% by weight for a 30 day use, and 10% by weight or double for a 60 day use. The deodorant additive added into the device preferably has a deodorant life of 30 to 60 days, which is generally longer than the deodorant life of conventional urinal block holders. When the deodorant scent additive is no longer effective, the dispersing device is simply thrown away and replaced. Because the urine dispersing device is disposable, a longer deodorant life saves resources.

Because the scent material can function as the deodorant agent, the traditional deodorant block is not needed, and the urine dispersing device 10 can serve both as a urine dispersing device and as a deodorant device. The scent additives can be chosen from many different conventional scents usually used in bathrooms for deodorant purposes. For example, the scent additive of the scented plastic material can be selected from the group consisting of flower scents and fruit scents. Preferably, the scent additive of the scented plastic material can be selected from the group consisting of mint scent, citrus scent, bubble gum scent and cherry scent.

In addition, the urine dispersing device of the present invention is preferably molded into one piece, thus providing a device which is inexpensive and easy to make in production and easy to transport and use in operation. It can also be made in separate parts and assembled together for sale and use, if desired.

The foregoing is considered as illustrative only of the principles of the invention. Since numerous modifications and changes will readily occur to those skilled in the art, it is not desired to limit the invention to the exact construction and operation shown and described. Accordingly, all suitable modifications and equivalents may be resorted to, falling within the scope of the invention.

What is claimed is:

1. A urine dispersing device for placement in a urinal comprising a framework made of a plastic material having a flexible segmented supporting base including a plurality of perforated segments and a central bottom frame having a central opening surrounded by said segments, and a central raised housing having a top member and an upstanding peripheral wall connecting said top member to said central bottom frame in said base, said peripheral wall including at least one opening, said top member including a top frame having a plurality of spaced parallel top member rods for dispersing urine flow while reducing splash back toward a user of the urinal.

2. The urine dispersing device as defined in claim 1, wherein said supporting base includes eight segments having substantially straight outer edges forming an octagon shape.

3. The urine dispersing device as defined in claim 1, wherein each of said segments includes a plurality of spaced base segment rods extending outwardly from the central bottom frame in a radial direction forming a plurality of openings in each said base segment.

4. The urine dispersing device as defined in claim 3, wherein each of said base segment rods includes a cut portion in a bottom surface thereof adjacent said central bottom frame to increase flexibility of each base segment rod thereby enabling said segments to conform to a bottom surface of said urinal.

5. The urine dispersing device as defined in claim 3, wherein each of said base segment rods progressively tapers outwardly from the central bottom frame to a smaller cross sectional area to increase flexibility of each segment.

6. The urine dispersing device as defined in claim 1, wherein said top member is in a generally arch shape.

7. The urine dispersing device as defined in claim 1, wherein said top member is generally horizontal.

8. The urine dispersing device as defined in claim 1, wherein said top member is inclined.

9. The urine dispersing device as defined in claim 1, wherein said upstanding peripheral wall tapers inwardly from said supporting base to permit stacking of multiple devices in a partially nested condition.

10. The urine dispersing device as defined in claim 1, wherein each of said top member rods includes a partial cylindrical upper surface and a V-shaped lower surface defining a narrow edge to facilitate dispersion of the urine flow.

11. The urine dispersing device as defined in claim 1, wherein said plastic material includes scented material incorporated therein having a scent life at least about 30 days.

12. The urine dispersing device as defined in claim 1, wherein said plastic material includes a scent additive of about 5 wt % to 10 wt % in composition.

13. The urine dispersing device as defined in claim 1, wherein said top member rods have a width approximately equal to an open spacing between said rods.

14. The urine dispersing device as defined in claim 1, wherein said plastic material includes a scent additive selected from a group including mint scents, citrus scents, bubble gum scents and cherry scents.

15. A deodorant urine dispersing device for placement in a urinal to reduce back splash of urine when using, said device comprising a framework made of plastic material containing at least one type of scent additive and having a horizontal segmented supporting base including a plurality of flexible perforated segments and a central bottom frame with a central opening surrounded by the segments, and a central raised housing having a top member and an inclined peripheral wall connecting said top member with said central bottom frame in said base, said inclined peripheral wall including at least one opening, said top member including a top frame having a plurality of spaced parallel rods defining a plurality of spaced parallel openings for dispersing urine flow while reducing splash back toward a user of said urinal.

16. The urine dispersing device as defined in claim 15, wherein each of said base segments includes a plurality of openings outwardly of the central bottom frame.

17. The urine dispersing device as defined in claim 15, wherein each of said rods in the top member includes a transversely curved upper surface and a lower surface defining a narrow edge to facilitate discharge of urine from said rods.

18. The urine dispersing device as defined in claim 16 wherein each of said base segment openings is defined by spaced radial rods forming slot openings, each of base segments extending rods progressively tapering to a smaller cross sectional area outwardly from said central bottom frame and a notch in a bottom surface adjacent to said central bottom frame to increase flexibility of said base segments.

19. A urine dispersing urinal insert comprising a flexible base member positioned in and conforming generally with the bottom surface of a urinal in overlying relation to a drain outlet in said bottom surface, said base member including an opening in alignment with said outlet, said opening being defined by a peripheral frame, a plurality of radially extending, flexible, perforated base segments connected to said frame to enable said base member to conform with and supportingly engage said bottom surface of said urinal, a plurality of spaced urine dispersing rods supported vertically above said frame in alignment with said opening and said outlet in said urinal, said dispersing rods being generally parallel and disposed in front to rear relation to said urinal and forming a urine target area with the spaces between said dispersing rods providing passage for urine directed toward the target area.

20. The urine dispersing insert as defined in claim 19 wherein said dispersing rods are supported from said frame by a support structure having flush water passages therein to enable flow of flush water from the urinal into said opening in the base member and into said urinal outlet.

* * * * *